US007469493B2

(12) United States Patent
Pacovsky

(10) Patent No.: US 7,469,493 B2
(45) Date of Patent: Dec. 30, 2008

(54) CORNER MOUNTABLE ARTISTS CANVAS

(75) Inventor: John Pacovsky, Wilkes-Barre, PA (US)

(73) Assignee: Tara Materials Inc., Lawrenceville, GA (US)

( * ) Notice: Subject to any disclaimer, the term of this patent is extended or adjusted under 35 U.S.C. 154(b) by 0 days.

(21) Appl. No.: 11/755,247

(22) Filed: May 30, 2007

(65) Prior Publication Data

US 2007/0277407 A1 Dec. 6, 2007

Related U.S. Application Data

(60) Provisional application No. 60/808,979, filed on May 30, 2006.

(51) Int. Cl.
*D06C 3/06* (2006.01)
*D05C 1/02* (2006.01)

(52) U.S. Cl. ..... 38/102.91

(58) Field of Classification Search ..... 38/102–102.91; 160/371–381; 40/700, 743, 745
See application file for complete search history.

(56) References Cited

U.S. PATENT DOCUMENTS 259,771 A * 6/1882 McLoughlin ..... 40/733
929,583 A * 7/1909 Gibbs ..... 38/102.2
2,756,529 A * 7/1956 Mazzocco ..... 40/716
3,833,046 A * 9/1974 Tombu ..... 160/327
3,886,990 A * 6/1975 Campione ..... 160/374.1
3,950,869 A * 4/1976 Samarin ..... 38/102.91
4,430,815 A * 2/1984 Wulc ..... 38/102.91
5,020,254 A * 6/1991 Sheppard ..... 40/603
6,619,003 B2 * 9/2003 Von Arx et al. ..... 52/222
7,117,621 B2 * 10/2006 Chang ..... 40/738

* cited by examiner

*Primary Examiner*—Ismael Izaguirre
(74) *Attorney, Agent, or Firm*—Laurence P. Colton; Smith, Gambrell & Russell

(57) ABSTRACT

A stretched painting canvas having a stretcher bar structure and a canvas wrapped across the stretcher bar structure so as to create a display surface, wherein at least two opposing sides of said stretcher bar are angled inward relative to said display surface such that a sum of said opposing sides' inward angles is equal to the angle formed by two intersecting walls, where each said inward angle of said opposing sides is greater than 0 degrees and said angle formed by two intersecting walls is greater than 0 degrees but less than 180 degrees.

20 Claims, 8 Drawing Sheets

CORNER MOUNTABLE ARTISTS CANVAS

CROSS-REFERENCE TO RELATED APPLICATIONS

This patent application claims priority on U.S. Provisional Patent Application 60/808,979, filed on 30 May 2006.

BACKGROUND OF THE INVENTION

1. Technical Field

This invention is related to the field of stretched painting canvases and more particularly is related to the field of stretched painting canvases of unconventional structural configurations that may be placed in the corner formed by two intersecting walls.

2. Related Art

The use of stretched painting canvas is known in the prior art. For centuries, artists have painted on canvas material that has been placed over a frame, which is often referred to as a stretcher, or stretcher bars. The viewer sees the painted display surface of the canvas but generally does not see the stretcher bars. The most common stretcher bars are rectilinear pieces of wood or other material joined together to make a rectangular structure. For example, the stretcher bars generally have a rectangular cross-section corresponding to the height and width of the stretcher bars, and a length. Four of these stretcher bars are joined together to form the rectangular structure on which the artists canvas is mounted for painting.

Prior stretched painting canvases have been structures so as to be mountable on walls such that the plane of the display surface is parallel to the wall. To angle the plane of the display surface in any other manner required a special frame. Additionally, as the corners of the rectilinear stretcher bars now would contact the walls should the conventional stretched painting canvas be hung in a corner, it would be difficult for the mounting hardware to cooperate with the stretched painting canvas, making an insecure or aesthetically unpleasing mounting. Further, when hanging the conventional stretched painting canvas in a corner, the structure and shape of the stretcher bars would be aesthetically unpleasing. Accordingly, a stretched painted canvas could not be placed in a corner formed by two intersecting walls. The use of a frame, however, limited the types of images conveyed by the artist. As a result, artistic creativity has been limited.

Thus, there is a need for an improved stretched artist canvas device that is structured for mounting in a corner. It is to such a stretched artist canvas that the present invention is primarily directed.

BRIEF SUMMARY OF THE INVENTION

The present invention, however, satisfies the need for an alternative medium to display a canvas. The present invention is structured so that it may be placed and mounted within a corner formed by two intersecting walls without a frame. This benefit is accomplished through the use of angled stretcher bars that permit the canvas to fit within the corner. Briefly, the stretcher bars can have a cross-section with at least one side being angle for fitting in a corner. For example, a cross-section in the shape of a rhombus, triangle, trapezoid, or half-trapezoid is suitable. Thus, when the stretcher bars are joined together to form the stretching backing for the canvas, a preferred cross-section of the joined stretcher bars can be trapezoidal in shape. Moreover, this invention offers an additional benefit. When this invention is mounted parallel to a wall like a traditional painting, it delivers a three-dimensional or floating effect to the viewer.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE PREFERRED EMBODIMENTS

With reference to the figures in which like numerals represent like elements throughout, embodiments of the present invention are shown. The figures and the following description are for a limited number of embodiments for ease of understanding. However, the invention is not limited to these illustrative embodiments.

The invention is fundamentally a stretched artists canvas attached to a stretcher bar structure wherein at least two sides of the stretcher bar structure have been angled inward to enable the placement of the stretched artists canvas within the corner formed by two intersecting walls. The display surface of the artists canvas would be presented at an angle that is parallel to neither intersecting wall.

Generally, the artists canvas could be any of the conventional materials for artists canvas, such as cloth-based (linen), including cotton, silk, and synthetic fibers, or paper-based. Most practically, the canvas would preferably be the traditional, cloth-based canvas material known within the art as linen. The canvas can be coated or uncoated. The preferred embodiment of the stretcher bars would be composed of wood. Metal, plastic, Styrofoam® multicellular expanded synthetic resinous material, and cardboard, however, are among the alternatives than can be used.

Figure 1:
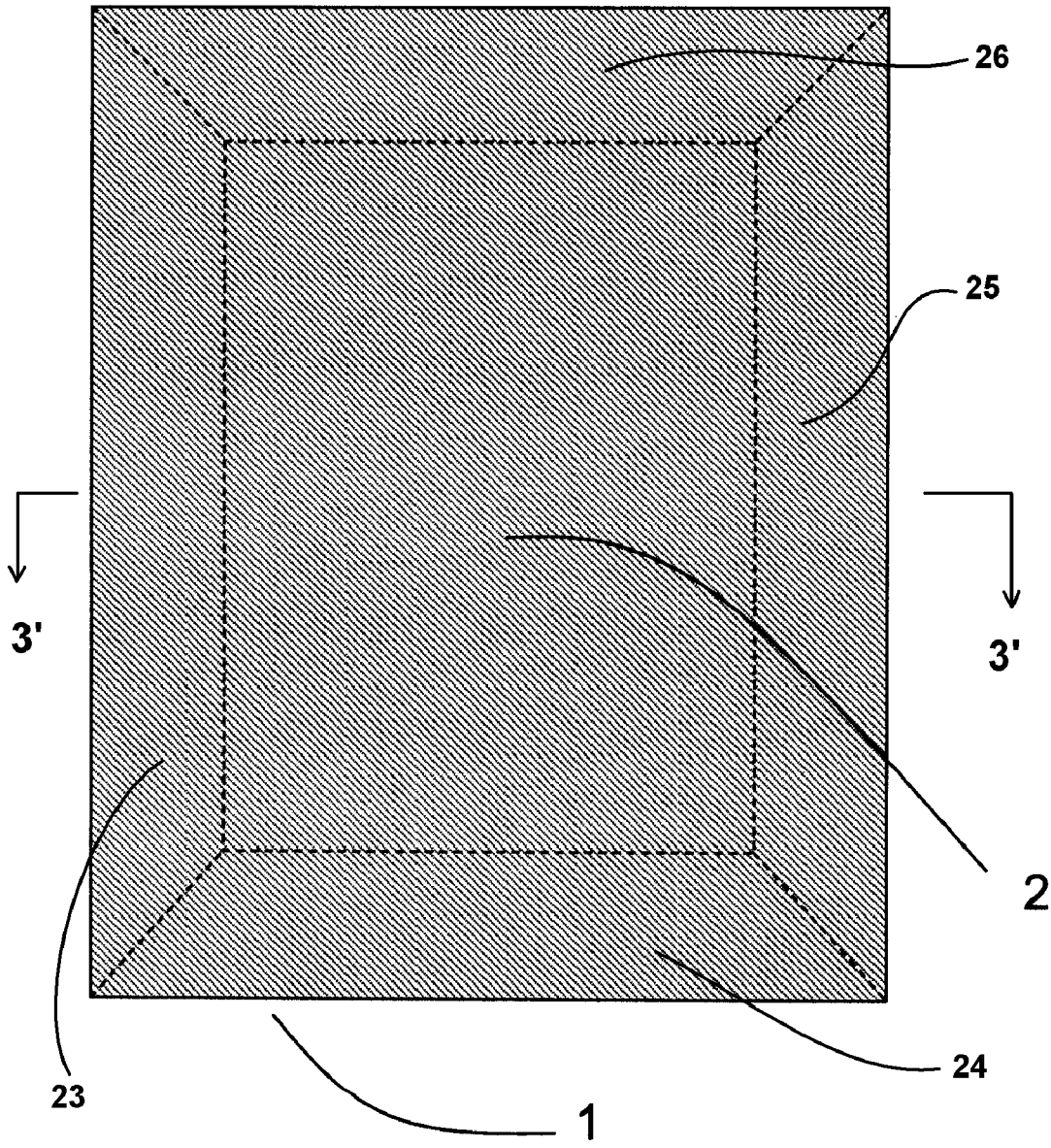
FIG. 1 is a front view of a preferred embodiment of the present invention.

FIG. 1 depicts a front view of a preferred embodiment of the invention as a four-sided stretched painting canvas 1. The artists canvas 2 is wrapped across wooden stretcher bars 23, 24, 25, 26 and stapled at the back to the stretcher bars 23, 24, 25, 26. A display surface 30 on the front of the stretched painting canvas 1 is created from this wrapping. This front view is what the art viewer sees, with the artistic creation primarily on the display surface. The formation of a general stretched painting canvas 1 in this manner is conventional and known in the art.

Figure 2:
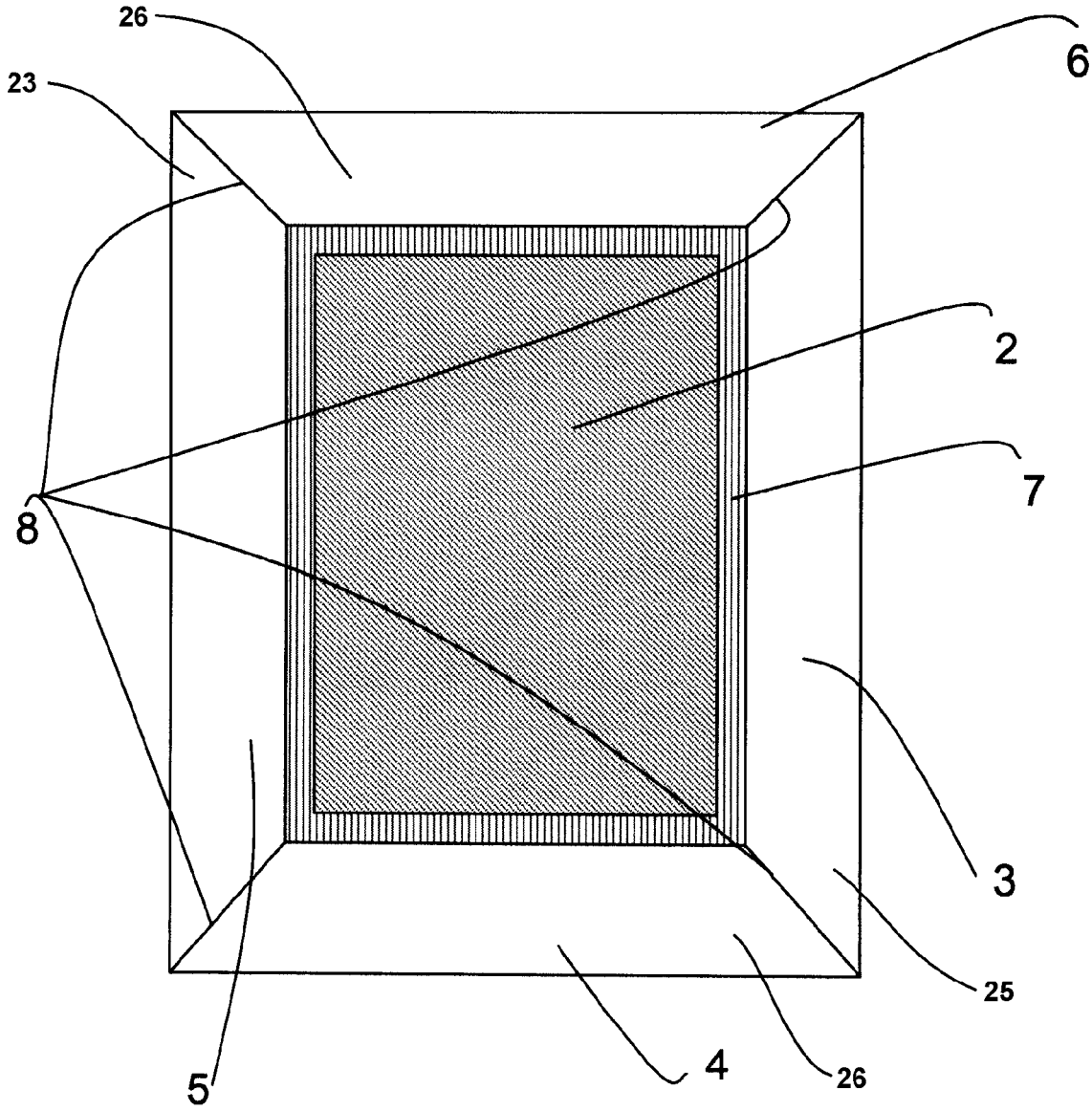
FIG. 2 is a rear view of a preferred embodiment of the present invention.

FIG. 2 depicts a rear view of the preferred embodiment of the invention shown in FIG. 1. This view illustrates angled stretcher bar sides 3, 4, 5, 6, with stretcher bar sides 3, 4, 5, 6 being angled inward relative to the plane of the display surface 30 at between 0 degrees and 90 degrees, and preferably 45 degrees. The intersections of the stretcher bars 23, 24, 25, 26 are reflected by the lines 8, and any conventional joining technique can be used.

FIG. 3 depicts several cross-sectional views of illustrative stretcher bars 23, 24, 25, 26 taken along line 3'-3' of FIG. 1. FIG. 3A illustrates a rhombus cross-section, with each stretcher bar 23, 24, 25, 26 having the rhombus cross-section shown for stretcher bars 23, 25. Stretcher bars 23, 25 are shown as coming out of the page and stretcher bar 24 is shown as a third side connecting stretcher bars 23, 25. Stretcher bar 26 is not shown in this cross-section. Artists canvas 2 is shown wrapping around the stretcher bar structure and stapled to the stretcher bars 23, 24, 25, 26. Staples 40 are a common attachment means, but any of the known or common attachment means are suitable. Artists canvas 2 preferably wraps all the around the stretcher bar structure such that stretcher bar sides 3, 4, 5, 6 are completely covered by artists canvas 2 and staples 40 do not show, that is, are not apparent to the viewing public.

Figure 3A:
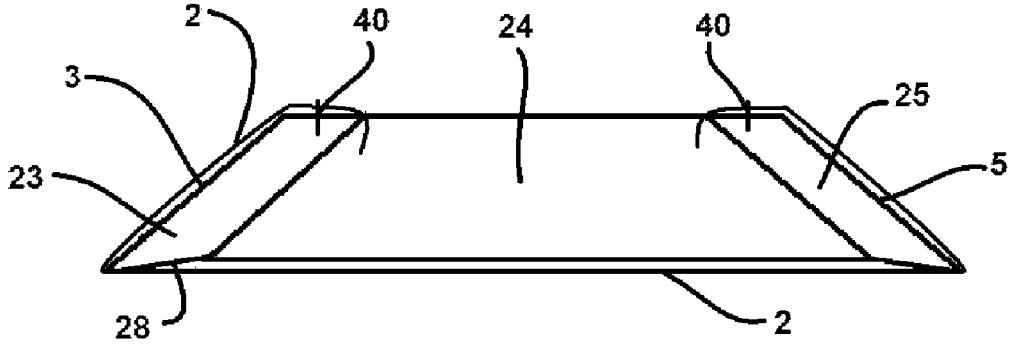
FIG. 3 are cross-sections of various alternative embodiments of the stretcher bars of the present invention taken along line 3'-3' of FIG. 1, with FIG. 3A being a rhombus, FIG. 3B being a triangle, FIG. 3C being a trapezoid, and FIG. 3D being a half-trapezoid.
Figure 3B:
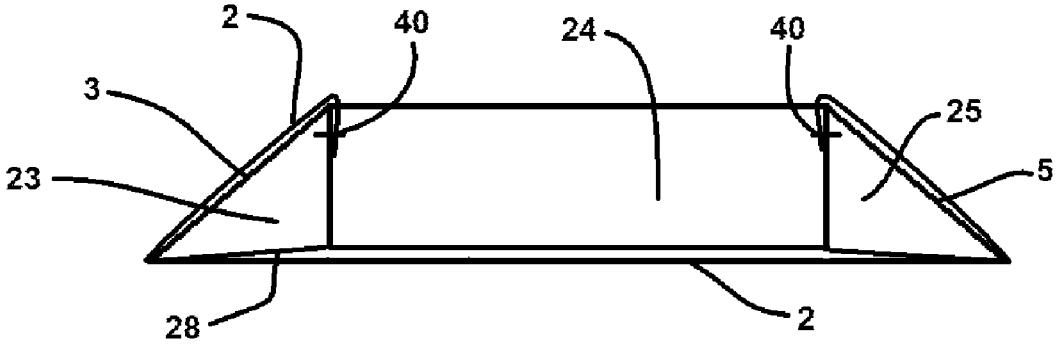
Figure 3C:
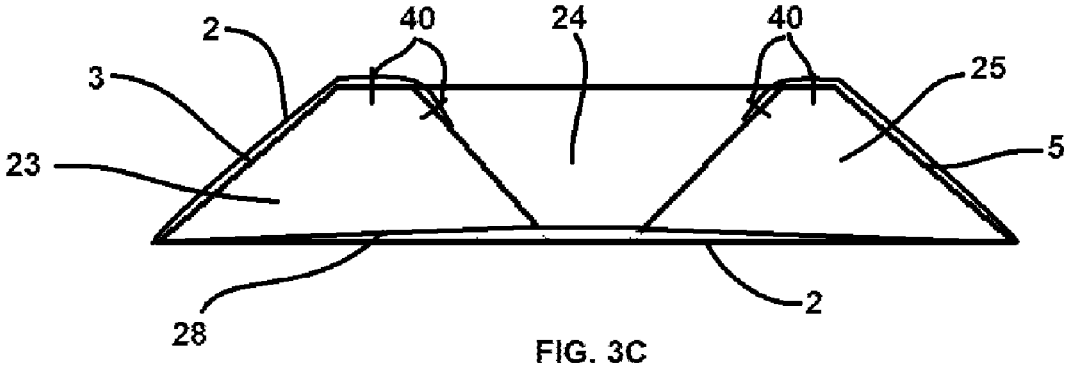
Figure 3D:
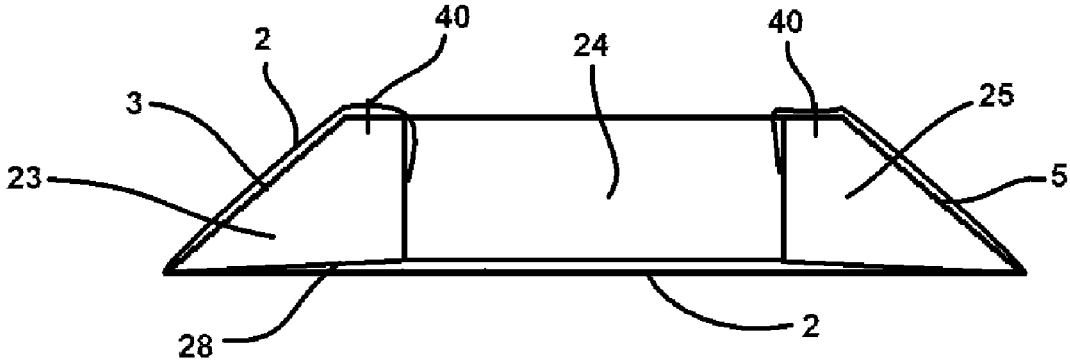

FIG. 3B illustrates a triangle cross-section for stretcher bars 23, 24, 25, 26, FIG. 3C illustrates a trapezoid cross-section for stretcher bars 23, 24, 25, 26, and FIG. 3D illustrates a half-trapezoid cross-section for stretcher bars 23, 24, 25, 26. Other cross-section shapes are suitable for this invention, and the invention is not limited to these four cross-section shapes. For all cross-section shapes, stretcher bars 23, 24, 25, 26 are joined to form the stretcher bar structure on which the artists canvas 2 is attached in the manner discussed above. The rhombus shape of FIG. 3A is preferred as it achieves a satisfactory combination of strength and material cost.

Also, as can be seen in FIG. 3, the front sides of stretcher bars 23, 24, 25, 26, as shown in representative example by reference numeral 28, do not necessarily have to be parallel to the display surface 30 of artists canvas 2. Preferably, the front sides 28 angle backwards by a small degree from the outer front edges to the inner front edges of stretcher bars 23, 24, 25, 26 such that the artists canvas 2 does not contact the front side 28 of the stretcher bars 23, 24, 25, 26. This prevents the stretcher bars 23, 24, 25, 26 from contacting the artists canvas 2 and creating flats or bends in the artists canvas 2, and allows for a flexible surface over a greater area of artists canvas 2.

Figure 4:
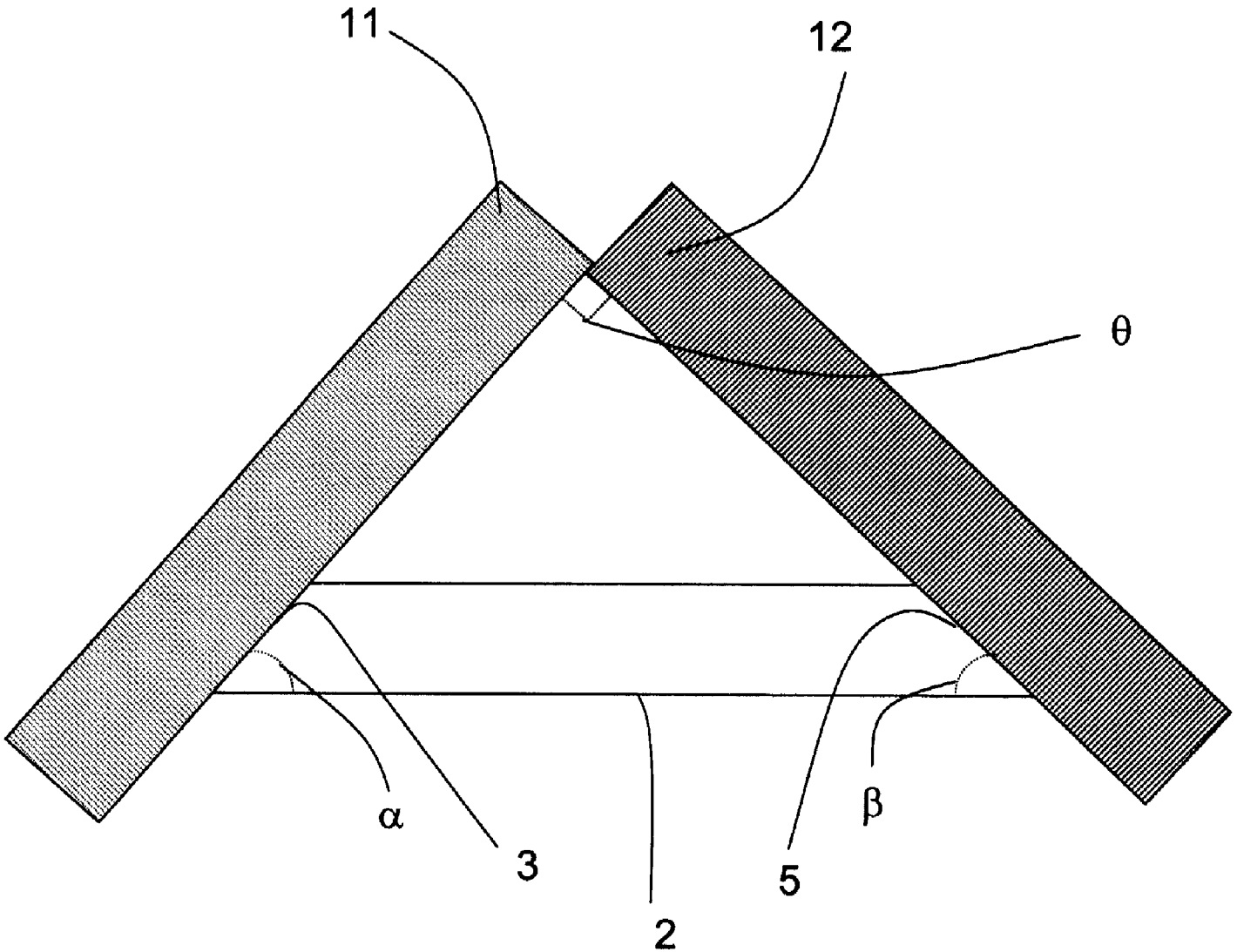
FIG. 4 is a top view of the present invention placed within the corner of two intersecting walls.
Figure 5:
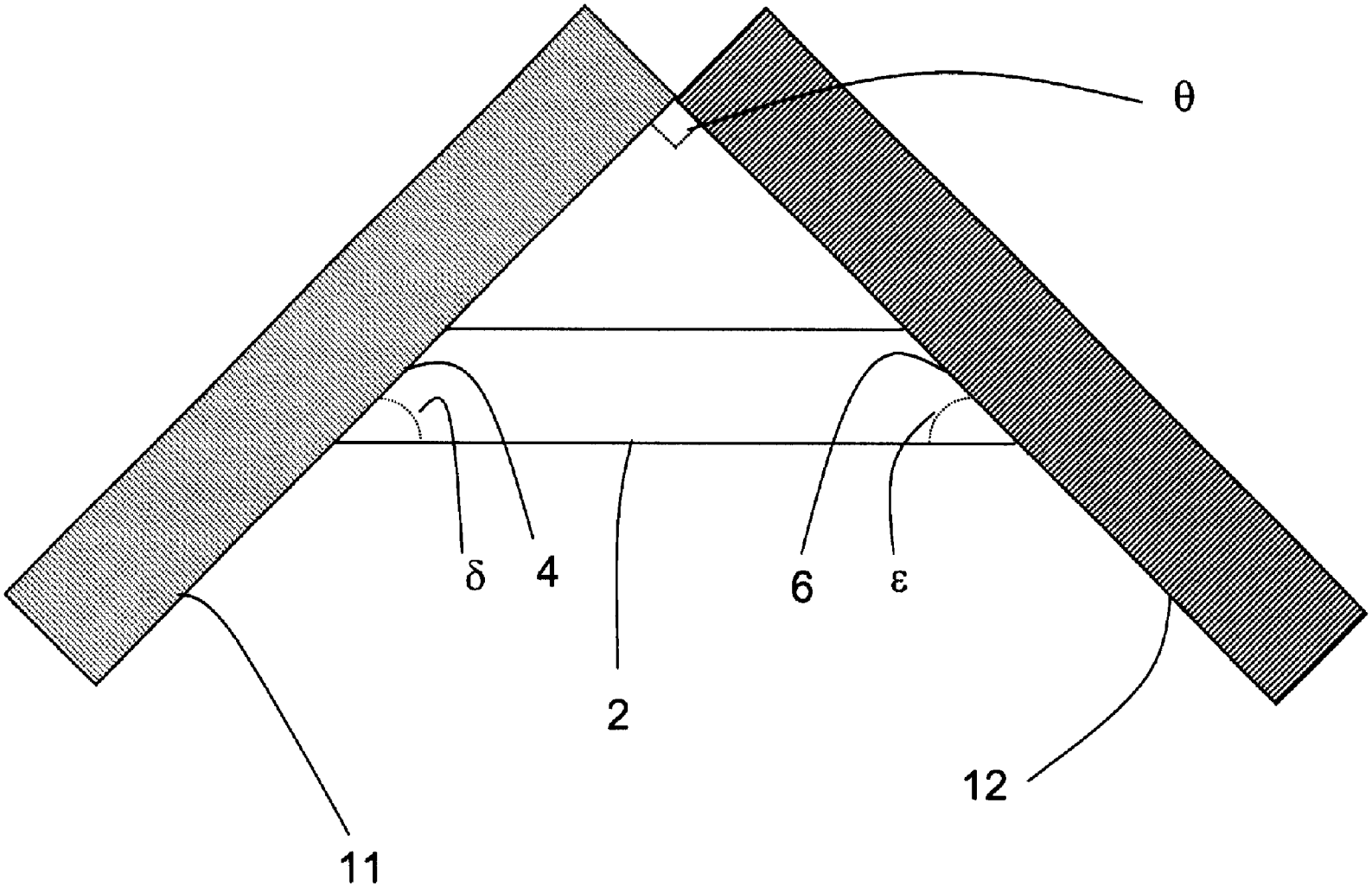
FIG. 5 is a top view of the present invention rotated on a different side than in FIG. 4 and placed within the corner of two intersecting walls.

FIG. 4 and FIG. 5 illustrate the angles $\alpha$, $\beta$ between the front side of stretcher bars 23, 24, 25, 26 and the angled sides 3, 4, 5, 6 of stretcher bars 23, 24, 25, 26. In these views, the stretched painting canvas 1 is a rectangular structure as shown in FIG. 1. FIG. 4 illustrates a top view of the present invention wherein opposing sides 3, 5 each touch wall 11, 12, respectively. Similarly, FIG. 5 illustrates a top view of the present invention wherein opposing sides 4, 6 touch walls 11, 12, respectively. In FIGS. 4 and 5, the angle between walls 11, 12 is 90 degrees, and thus angle $\alpha$ is the complementary angle to angle $\beta$ and angle $\delta$ is the complementary angle to angle $\epsilon$. Because the angles $\alpha$ and $\beta$, as well as $\delta$ and $\epsilon$ are complementary to each other, their combined total is 90 degrees. Accordingly, the stretched painting canvas is able to fit within the 90-degree angle $\theta$ created by the intersection of perpendicular walls 11, 12. Specifically, in the preferred embodiment, all angles $\alpha$, $\beta$, $\delta$, $\epsilon$ are 45 degrees. However, in the event one does not want a canvas to fit at a 45 degree angle to walls 11, 12, angles $\alpha$, $\beta$, $\delta$, $\epsilon$ can be altered during manufacture. For example, angle $\alpha$ can be 30 degrees and angle $\beta$ can be 60 degrees, while angle $\delta$ can be 40 degrees and angle $\epsilon$ can be 50 degrees. For perpendicular walls, any combination of complimentary angles can be used.

In the preferred embodiment, the plane parallel to and across the stretcher bars 23, 24, 25, 26 from the display surface 30 is not a solid surface composed of stretcher bars 23, 24, 25, 26. Instead, the artists canvas 2 is stapled along the edge 7 (see FIG. 2) of the stretcher bar structure. Alternatively, the artists canvas 2 can be stapled on interior surfaces of the stretcher bars 23, 24, 25, 26. Preferably, as mentioned above, the artists canvas 2 is stapled to the stretcher bars 23, 24, 25, 26 such that the staples 40 do not show to the public viewer.

Placement of the invention within the corner of a wall 11, 12 is possible through several means. Here, the preferred embodiment uses conventional mounting means for stretched painting panels without frames, such as tacks to connect the present invention to a wall. Alternatively, a combination of nails into the walls and hooks into the stretched painting canvas offer another means for placement. Glue is an additional alternative. Users may also place the edge of the stretched painting canvas on a surface within the corner and let it rest in place against the wall, with portions of two opposing sides touching the wall. Regardless of mounting method, however, only two sides of the invention need to be in contact with the wall at any time. As will be obvious to those of skill in the art, the invention, due to its structure, can be mounted on the two walls 11, 12 forming the corner using conventional means, rather than the unconventional means often necessary for prior art stretched painting panels.

Figure 6:
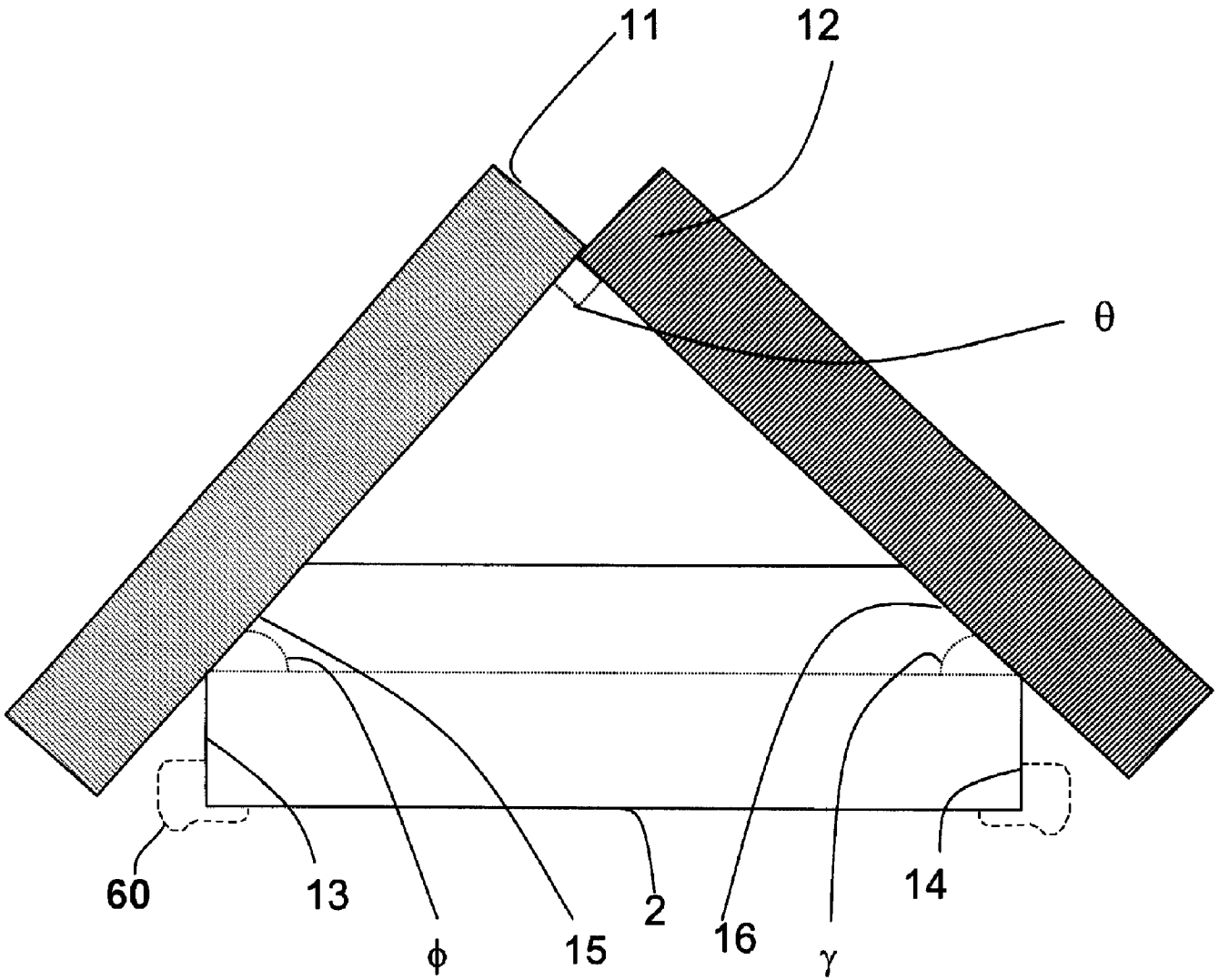
FIG. 6 is a top view of an alternative embodiment of the present invention with an intermediate side placed within the corner of two intersecting walls.

FIG. 6 illustrates an alternative embodiment of the present invention. In the embodiment shown in FIG. 1, the display surface 30 appears to be more of a continuous surface with the walls 11, 12, with only an obtuse angle between wall 11 and display surface 30 and between display surface 30 and wall 12. This gives a smooth look. In the embodiment of FIG. 6, only a portion of at least tow of sides 3, 4, 5, 6 are angled. This lifts or extends the display surface 30 from the walls 11, 12 and gives a more 3-dimensional look to the invention. In this embodiment, the opposing sides 15, 16 that are at complementary angles relative to the display surface 30 (assuming perpendicular walls 11, 12) are not immediately connected to the display surface 30. Instead, intermediate sides 13, 14 separate the display surface 30 from the opposing sides 15, 16. The inward angles $\phi$ and $\gamma$ of the opposing sides 15, 16 relative to the display surface 30 still are complementary to each other, however, with a perpendicular wall 11, 12 arrangement. In this embodiment, it also is possible to place a frame 60 (ghost lines) about the stretched painting canvas 1 without interfering with the hanging of the stretched painting canvas 1 on the wall 11.

Figure 7:
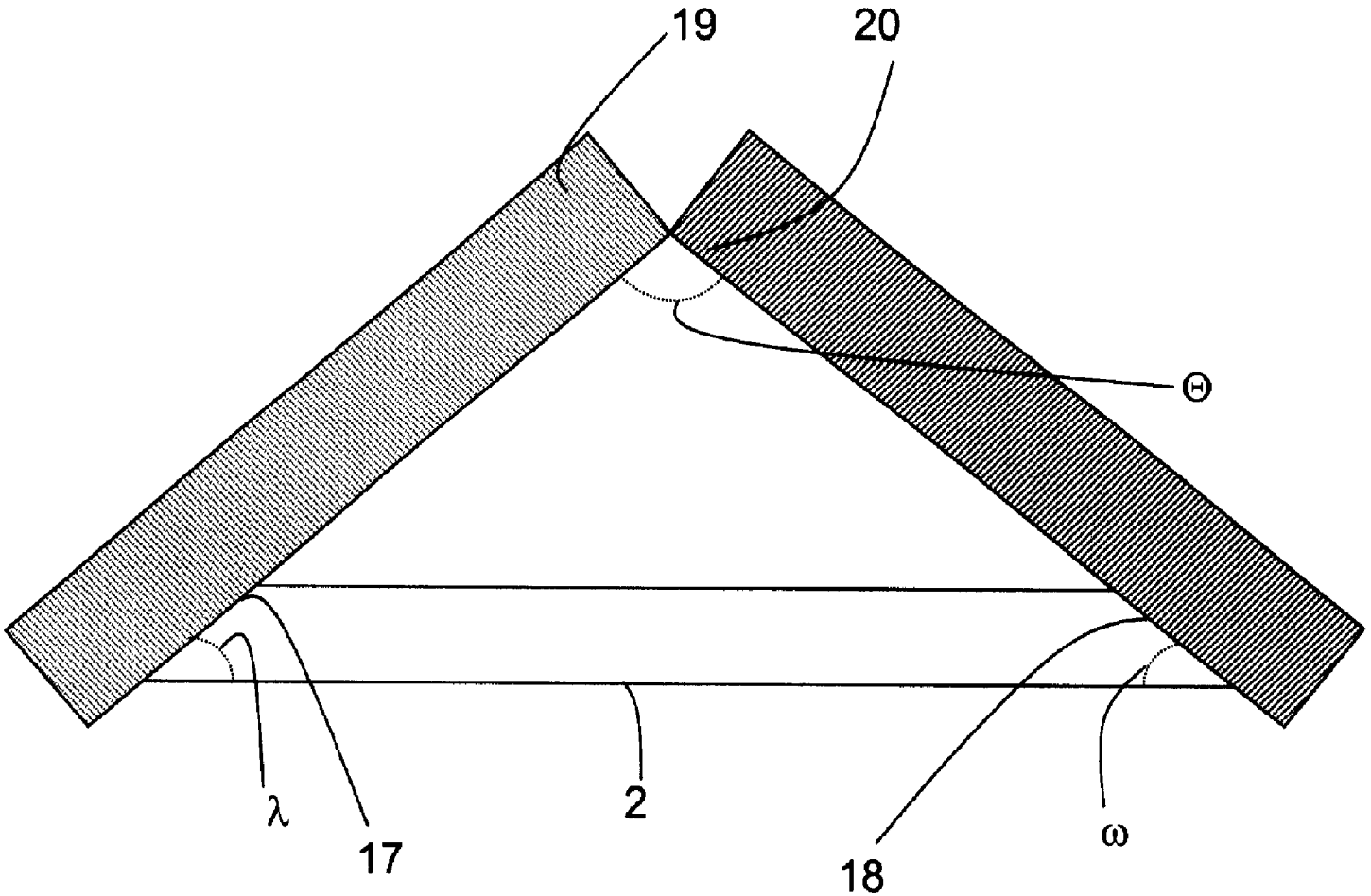
FIG. 7 is a top view of the present invention for walls that intersect at an angle other than 90 degrees.

FIG. 7 illustrates another embodiment of the invention manufactured for walls that are not perpendicular to each other. The aforementioned embodiments only demonstrate a stretched painting canvas 1 preferably made to fit within the 90-degree intersection of intersecting perpendicular walls. Walls can intersect at other angles less or more than 180 degrees. The present invention continues to function within such corners when the sum of the inward angles $\lambda$, $\omega$ of each opposing side 17, 18, respectively, relative to the display surface 30 plus the angle $\Theta$ between the walls 19, 20 equal 180 degrees. FIG. 7 demonstrates one such embodiment of the invention. There, the opposing angles $\lambda$ and $\omega$ are not complementary angles summing to 90 degrees. Instead, they plus angle Θ sum to 180 degrees. In FIG. 7, angle Θ is greater than 90 degrees but less than 180 degrees. Nonetheless, angle Θ could also be greater than 0 degrees and less than 180 degrees, and the present invention will continue to function as intended as long as the sum of angles λ and ω and Θ continue to equal 180 degrees.

Figure 8:
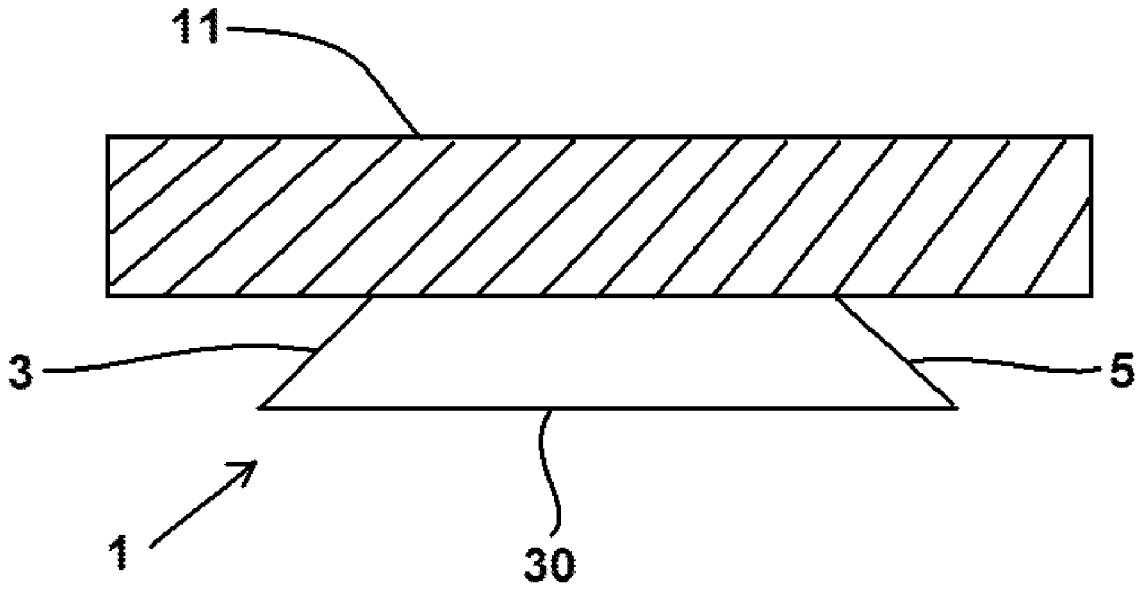
FIG. 8 is a top view of the present invention hung on a single wall.

FIG. 8 illustrates the present invention hung on a single wall. Regardless of the angles of the sides 3, 4, 5, 6, the present invention will be able to display images in the conventional method wherein the display surface 30 is parallel to a wall 11. Used in such a manner, the present invention offers the added benefit of creating a three-dimensional effect, or floating, effect because of the inward slope of its sides 3, 4, 5, 6 behind the display surface 30.

As can be seen from this specification, the overall structure of the invention as well as the various components can be varied in size, shape, angle, material, and overall cross-section without departing from the scope of the invention. The invention can be manufactured in all different sizes, from very small to very large, similar to conventional canvases. The invention can be manufactured in various shapes so long as two opposing sides or edges are angled to contact the walls forming the corner. For example, an oval, circle, or regular or irregular polygon can be used. The angle of the angled side also can be varied, as disclosed previously, so as to fit various wall intersection angles. The invention can be manufactured out of various materials, including but not limited to woods, ceramic, plastics and other polymers, metal cardboard, Styrofoam® multicellular expanded synthetic resinous material, composites and other materials so long as the artists canvas can be secured to the material of manufacture of the stretcher bars. Likewise, the means for securing the artists canvas to the stretcher bars can be selected from known and future developed attachment means, including but not limited to staples, nails, screws, adhesives, clips, and tacks. As can be seen in a comparison of FIG. 3 and FIG. 6, the cross-section also can be somewhat variable, but preferably is a regular trapezoid.

So, one embodiment of the invention is a stretched painting canvas for mounting is a corner created by two intersecting walls, comprising a stretcher bar structure and an artists canvas wrapped around the stretcher bar structure so as to create a front display surface, wherein at least two opposing sides of said stretcher bar structure are angled inward and rearward relative to the display surface to create two angled edges such that a first of the two angled edges contacts a first of the intersecting walls and a second of the two angled edges contacts a second of the two intersecting walls.

Another embodiment of the invention further comprises a stretcher bar structure is comprised of a plurality of stretcher bars, each stretcher bar is comprised of at least three bar sides and two bar ends, the stretcher bars are joined to each other at the ends to form the stretcher bar structure, the stretcher bar structure has a generally frontward facing surface comprised of a first of the at least three bar sides of each of the plurality of stretcher bars, and the stretcher bar structure has a mounting surface comprised of the angled edges, the angled edges being comprised of a second of the at least three bar sides of at least two of the plurality of stretcher bars.

Other embodiments of the invention comprise the artists canvas covering the frontward facing surface and wrapping around the mounting surface, the angled edges angle being at approximately 45 degrees relative to the frontward facing surface, the artists canvas being attached to the stretcher bar structure on a third of the at least three bar sides, and/or having an intermediate side separating the frontward facing surface from the mounting surface.

Another embodiment of the invention is a stretched painting canvas for mounting on a wall for creating a floating effect, comprising a stretcher bar structure and an artists canvas wrapped around the stretcher bar structure so as to create a front display surface, wherein at least two opposing sides of said stretcher bar structure are angled inward and rearward relative to the display surface to create two angled edges, and wherein the stretcher bar structure is comprised of a plurality of stretcher bars, each stretcher bar is comprised of at least three bar sides and two bar ends, the stretcher bars are joined to each other at the ends to form the stretcher bar structure; the stretcher bar structure has a generally frontward facing surface comprised of a first of the at least three bar sides of each of the plurality of stretcher bars, and the stretcher bar structure has a floating effect surface comprised of the angled edges, the angled edges being comprised of a second of the at least three bar sides of at least two of the plurality of stretcher bars.

The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A stretched painting canvas for mounting in a corner created by two intersecting walls, comprising:

a) a stretcher bar structure having a frontward facing surface; and b) an artists canvas wrapped around the frontward facing surface of the stretcher bar structure so as to create a front display surface, wherein at least two opposing sides of said stretcher bar structure are angled inward and rearward relative to the display surface to create two angled edges such that a first of the two angled edges contacts a first of the intersecting walls and a second of the two angled edges contacts a second of the two intersecting walls.

2. The stretched painting canvas as claimed in claim 1, wherein:

a) the stretcher bar structure is comprised of a plurality of stretcher bars;

b) each stretcher bar is comprised of at least three bar sides and two bar ends;

c) the stretcher bars are joined to each other at the ends to form the stretcher bar structure;

d) the frontward facing surface of the stretcher bar structure is comprised of a first of the at least three bar sides of each of the plurality of stretcher bars; and e) the stretcher bar structure has a mounting surface comprised of the angled edges, the angled edges being comprised of a second of the at least three bar sides of at least two of the plurality of stretcher bars.

3. The stretched painting canvas as claimed in claim 2, wherein the artists canvas covers the frontward facing surface and wraps around the mounting surface.

4. The stretched painting canvas as claimed in claim 2, wherein the angled edges angle at approximately 45 degrees relative to the frontward facing surface.

5. The stretched painting canvas as claimed in claim 2, wherein the artists canvas is attached to the stretcher bar structure on a third of the at least three bar sides.

6. The stretched painting canvas as claimed in claim 2, wherein the stretcher bars are composed of a material selected from the group consisting of wood, plastic, multicellular expanded synthetic resinous material, cardboard, metal, ceramic, and composites.

7. The stretched painting canvas as claimed in claim 2, wherein the artists canvas is composed of a cloth-based material or a paper-based material.

8. The stretched painting canvas as claimed in claim 1, wherein at least one intermediate side separates the frontward facing surface from the mounting surface.

9. A stretched painting canvas for mounting in a corner created by two intersecting walls, comprising:

a) a stretcher bar structure; and b) an artists canvas wrapped around the stretcher bar structure so as to create a front display surface, wherein at least two opposing sides of said stretcher bar structure are angled inward and rearward relative to the display surface to create two angled edges such that a first of the two angled edges contacts a first of the intersecting walls and a second of the two angled edges contacts a second of the two intersecting walls, wherein:

i) the stretcher bar structure is comprised of a plurality of stretcher bars;

ii) each stretcher bar is comprised of at least three bar sides and two bar ends;

iii) the stretcher bars are joined to each other at the ends to form the stretcher bar structure;

iv) the stretcher bar structure has a generally frontward facing surface comprised of a first of the at least three bar sides of each of the plurality of stretcher bars; and v) the stretcher bar structure has a mounting surface comprised of the angled edges, the angled edges being comprised of a second of the at least three bar sides of at least two of the plurality of stretcher bars.

10. The stretched painting canvas as claimed in claim 9, wherein the artists canvas covers the frontward facing surface and wraps around the mounting surface.

11. The stretched painting canvas as claimed in claim 10, wherein the artists canvas is attached to the stretcher bar structure on a third of the at least three bar sides.

12. The stretched painting canvas as claimed in claim 11, wherein the stretcher bars are composed of a material selected from the group consisting of wood, plastic, multicellular expanded synthetic resinous material, cardboard, metal, ceramic, and composites.

13. The stretched painting canvas as claimed in claim 12, wherein the artists canvas is composed of a cloth-based material or a paper-based material.

14. The stretched painting canvas as claimed in claim 12, wherein at least one intermediate side separates the frontward facing surface from the mounting surface.

15. The stretched painting canvas as claimed in claim 12, wherein the angled edges angle at approximately 45 degrees relative to the frontward facing surface.

16. A stretched painting canvas for mounting on a wall for creating a floating effect, comprising:

a) a stretcher bar structure; and b) an artists canvas wrapped around the stretcher bar structure so as to create a front display surface, wherein at least two opposing sides of said stretcher bar structure are angled inward and rearward relative to the display surface to create two angled edges, wherein:

i) the stretcher bar structure is comprised of a plurality of stretcher bars;

ii) each stretcher bar is comprised of at least three bar sides and two bar ends;

iii) the stretcher bars are joined to each other at the ends to form the stretcher bar structure;

iv) the stretcher bar structure has a generally frontward facing surface comprised of a first of the at least three bar sides of each of the plurality of stretcher bars; and v) the stretcher bar structure has a floating effect surface comprised of the angled edges, the angled edges being comprised of a second of the at least three bar sides of at least two of the plurality of stretcher bars.

17. The stretched painting canvas as claimed in claim 16, wherein the artists canvas covers the frontward facing surface and wraps around the floating effect surface.

18. The stretched painting canvas as claimed in claim 17, wherein the artists canvas is attached to the stretcher bar structure on a third of the at least three bar sides.

19. The stretched painting canvas as claimed in claim 18, wherein the stretcher bars are composed of a material selected from the group consisting of wood, plastic, multicellular expanded synthetic resinous material, cardboard, metal, ceramic, and composites and the artists canvas is composed of a cloth-based material or a paper-based material.

20. The stretched painting canvas as claimed in claim 19, wherein at least one intermediate side separates the frontward facing surface from the floating effect surface.

* * * * *